US007245069B2

(12) United States Patent
Elvin

(10) Patent No.: US 7,245,069 B2
(45) Date of Patent: Jul. 17, 2007

(54) FLUORESCENT ILLUMINATION DEVICE

(76) Inventor: Frederick William Elvin, 2458 Rochester Rd., Oakland, MI (US) 48363

( * ) Notice: Subject to any disclaimer, the term of this patent is extended or adjusted under 35 U.S.C. 154(b) by 326 days.

(21) Appl. No.: 10/913,830

(22) Filed: Aug. 5, 2004

(65) Prior Publication Data

US 2006/0028112 A1 Feb. 9, 2006

(51) Int. Cl.
*H01J 5/48* (2006.01)

(52) U.S. Cl. ..... 313/318.02; 313/318.01; 313/318.11

(58) Field of Classification Search ..... 313/318.02, 313/318.11; 362/223, 296
See application file for complete search history.

(56) References Cited

U.S. PATENT DOCUMENTS

| | | | | |
|---|---|---|---|---|
| 2,922,137 | A | 1/1960 | Krup et al. | |
| 3,156,841 | A | 11/1964 | Ayres | |
| 3,358,167 | A | 12/1967 | Shanks | |
| 3,558,873 | A * | 1/1971 | Smith | 362/223 |
| 3,772,559 | A | 11/1973 | Schoke | |
| 3,805,053 | A * | 4/1974 | Julinot | 362/223 |
| 4,924,368 | A | 5/1990 | Northrop et al. | |
| 5,291,379 | A * | 3/1994 | Lu | 362/255 |
| 5,422,800 | A * | 6/1995 | Entrop et al. | 362/219 |
| 5,510,965 | A | 4/1996 | Teakell | |
| 5,585,694 | A | 12/1996 | Goldburt et al. | |
| 5,716,123 | A * | 2/1998 | Lamming | 362/222 |
| 5,848,836 | A | 12/1998 | Graber et al. | |
| 6,135,620 | A | 10/2000 | Marsh | |
| 6,186,649 | B1 | 2/2001 | Zou et al. | |
| 6,305,816 | B1 * | 10/2001 | Corcorran et al. | 362/147 |
| 6,348,763 | B1 | 2/2002 | Collins | |
| 6,367,179 | B1 | 4/2002 | Marsh | |
| 6,465,971 | B1 | 10/2002 | Parra | |
| 6,515,433 | B1 | 2/2003 | Ge et al. | |
| 6,616,310 | B1 | 9/2003 | Marsh | |
| 6,641,278 | B1 | 11/2003 | Guritz | |
| 6,647,199 | B1 | 11/2003 | Pelka et al. | |
| 6,749,322 | B2 * | 6/2004 | Chen | 362/222 |

* cited by examiner

*Primary Examiner*—Nimeshkumar D. Patel
*Assistant Examiner*—Matt Hodges
(74) *Attorney, Agent, or Firm*—Raggio & Dinnin, P.C.

(57) ABSTRACT

An illumination device (10) that preferably includes a cold cathode fluorescent bulb (30), wherein the illumination device (10) further includes a substantially cylindrical casing (34) positioned about the bulb (30), and a reflector (32) substantially coextensive with a length of the bulb (30). An end cap (40) is provided that includes a locating surface (37) for the reflector (32), and a support for the bulb (30). A mounting member or fitting (18) is provided having a groove (19) adapted to receive a protrusion (42) from the casing (34) that allows relative rotation between the casing (34) and the fitting (18) less than 360°. A watertight fluorescent light (31) is further provided having a special four point seal that includes an O-ring (350) forming seals approximately at four radial positions about a cross sectional profile thereof.

11 Claims, 5 Drawing Sheets

FLUORESCENT ILLUMINATION DEVICE

TECHNICAL FIELD

The present invention relates generally to illumination devices, and relates more particularly to such a device having a cold cathode fluorescent light in a relatively small, compact and lightweight housing.

BACKGROUND OF THE INVENTION

Fluorescent lights have long been known in the art, and have in recent years received significant attention due to their relatively low power consumption and low heat output. Fluorescent lamps are used to provide illumination in typical electrical devices for general lighting purposes because they are more efficient than incandescent bulbs in producing light. A fluorescent lamp is a low pressure gas discharge source, in which light is produced predominantly by fluorescent powders activated by ultraviolet energy generated by a mercury plasma forming an arc. The lamp, usually in the form of a tubular bulb with an electrode sealed into each end, contains mercury vapor at low pressure with a small amount of inert gas for starting. The inner walls of the bulb are coated with fluorescent powders commonly called phosphors. When the proper voltage is applied, the plasma forming an arc is produced by current flowing between the electrodes through the mercury vapor. This discharge generates some visible radiation. The ultraviolet light in turn excites the phosphors to emit light.

Two electrodes are hermetically sealed into the bulb, one at each end. These electrodes are designed for operating as either "cold" or "hot" cathodes or electrodes, more correctly called glow or arc modes of discharge operation. Electrodes for glow or cold cathode operation may consist of closed-end metal cylinders, generally coated on the inside with an emissive material. "Cold" refers to electrodes that do not rely on additional means of thermonic emission besides that created by the electrical discharge through the tube. In contrast, hot cathode fluorescents include an electrode in the form of a filament, heated with current passing there through, which provides enhanced emissions from the lamp.

Conventional cold cathode lamps operate at a current on the order of a few hundred milliamps, with a high cathode fall or voltage drop, something in excess of 50 volts. CCFLs are not appreciably affected by starting frequency because of the type of electrode used. CCFLs emit light in the same way as do standard hot electrode lamps. In general, the latter type operate as normal glow discharges and their electrodes are uncoated hollow cylinders of nickel or iron.

The cathode fall is high and to obtain high efficacy or power for general lighting purposes, conventional lamps are made fairly long, about 2–8 feet, with a diameter of about 25–40 millimeters. About 2000 volts is required for starting these conventional lamps and about 900 to 1000 volts for running. The advantages of CCFLs compared with the hot electrode fluorescent lamps are that they typically have a very long life, in consequence of their rugged electrodes, lack of filament and low current consumption. They start fairly quickly, even under cold ambient conditions. Their life is unaffected by the number of starts. Also, they may be dimmed to relatively low levels of light output.

SUMMARY OF THE INVENTION

It is an object of the present invention to provide a simple and compact lighting device, particularly well suited for mounting in the interior of a confined space such as a storage cabinet.

It is a further object of the present invention to provide a simple and highly efficient design for a substantially water-tight illumination device.

It is a further object of the present invention to provide an adjustable illumination device.

In one aspect, the present invention provides an illumination device having an elongate bulb and an outer casing substantially coextensive with the bulb and surrounding the same. An end cap is positioned at an end of the outer casing and includes a skirt extending radially about the bulb. The end cap includes at least one locating surface defined by the skirt. A reflector extends longitudinally in the interior space and includes an end portion positioned against the locating surface whereby the reflector is positioned and maintained substantially at a preselected distance from the bulb.

BRIEF DESCRIPTION OF THE DRAWINGS

FIG. 13 is a perspective view of a lighting system in a remote mounting configuration according to the present invention.

DETAILED DESCRIPTION OF PREFERRED EMBODIMENTS

Figure 1A:
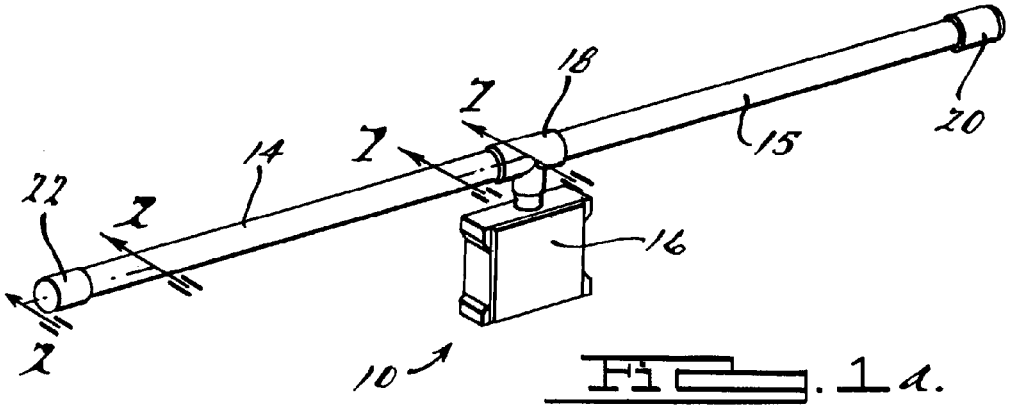
FIGS. 1*a–e* illustrate various perspective views of an illumination device according to the present invention.
Figure 1B:
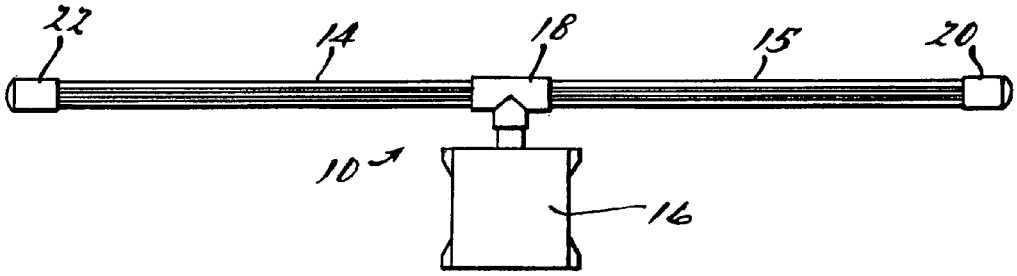
Figure 1C:
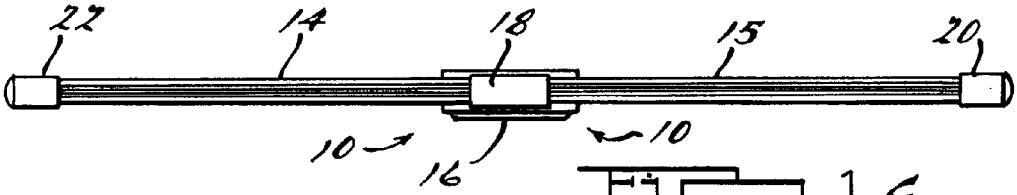
Figure 1D:
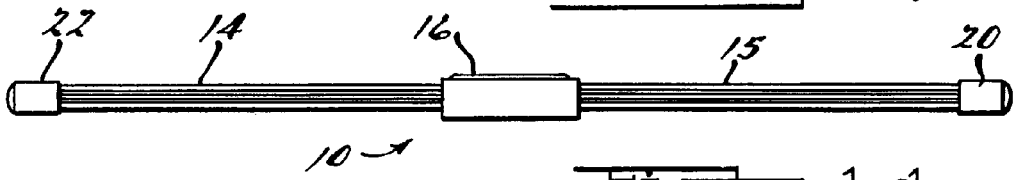
Figure 1E:
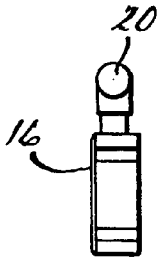

Referring to FIGS. 1*a–e*, there are shown various views of one preferred embodiment of the present invention. An illumination device 10 is provided, preferably including first and second illumination units 14 and 15, extending from an electrical housing 16. A mounting member or fitting 18 is provided and supports units 14 and 15. End covers 20 and 22 are positioned over distal ends of units 15 and 14, respectively. Device 10 preferably has a relatively shallow profile, as illustrated in FIG. 1*e*, allowing it to be readily placed in relatively confined spaces such as within a cabinet or under a shelf.

Figure 2:
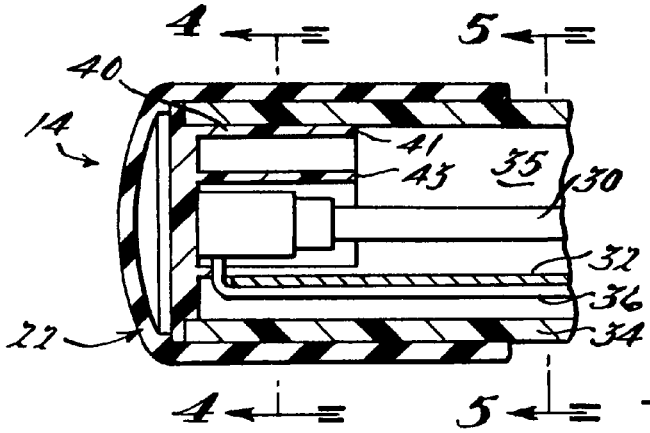
FIG. 2 is a partially sectioned view taken along line 2—2 of FIG. 1.

Turning now to FIG. 2, there is shown a partially sectioned view of unit 14 taken along line 2—2 of FIG. 1*a*. Units 14 and 15 are preferably substantially identical and the description herein of unit 14 should be understood to refer also to unit 15. Unit 14 preferably includes a transparent or translucent tube or casing 34 defining an interior space 35 within which various components of the device are positioned. Casing 34 is preferably formed from a substantially transparent, extrudable material such as an acrylic, however, it should be appreciated that alternative suitable materials such as glass or various plastics might be used without departing from the scope of the present invention. Rather than transparent materials, colored or frosted casings might be used.

An elongate fluorescent light bulb 30, preferably a cold cathode fluorescent ("CCFL"), is preferably positioned within interior space 35. It should be appreciated that any suitable light bulb might be used and the description herein of CCF bulbs should not be taken as limiting. For certain applications, for example under a kitchen cabinet, it may be desirable to provide a bulb having a significant proportion of its output as UV light such that the illumination device may also serve a sterilizing function for dishware and related items.

A reflector 32 is preferably positioned within space 35, and may be formed from any suitable material or by any suitable process. In a preferred embodiment, reflector 32 is preferably substantially parabolic in cross section and is roll formed from an elongate, flat piece of starting material. Reflector 32 is preferably positioned at a substantially constant distance from bulb 30 along a length thereof, and is most preferably positioned such that the cylindrical axis of bulb 30 lies substantially at the focal point of reflector 32, where a parabolic reflector is used.

Figure 4:
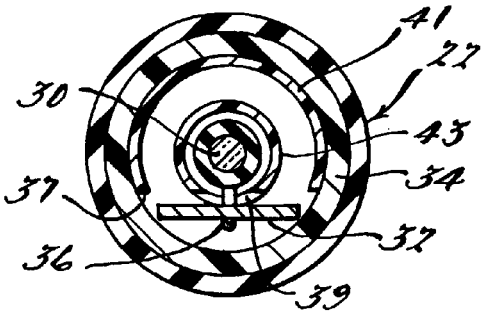
FIG. 4 is a partially sectioned view taken along line 4—4 of FIG. 2.

An end cap 40 is preferably positioned at an end of casing 34 and is fashioned such that it appropriately positions and supports both of bulb 30 and reflector 32. End cap 40 is preferably molded plastic; however, it might be formed by some other method or from other materials without departing from the scope of the present invention. In a preferred embodiment, bulb 30 may be mounted to end cap 40 by any suitable means, for example by positioning bulb 30 in a pocket formed therein or by attaching bulb 30 to end cap 40 with an adhesive. An electrical connection line 36 preferably runs from the distal end of bulb 30 behind reflector 32, and thenceforth back to housing 16 via an interior of fitting 18. Embodiments are contemplated wherein reflector 32 serves as an electrical return line for the electrical circuit of which bulb 30 is a part. End cap 40 is preferably formed having an outer skirt 41 and inner skirt 43. In a preferred embodiment, both of inner and outer skirts 41 and 43 are substantially partially cylindrical and coaxial with bulb 30. Referring to FIG. 4, there is shown a cross section taken along line 4—4 of FIG. 2. Each of skirts 41 and 43 preferably includes opposite ends separated by a gap. The ends preferably serve as locating and support surfaces for reflector 32, at each of first 37 and second 39 surfaces. It should be appreciated that first and second surfaces 37 and 39 are referred to in the singular, however, those skilled in the art will appreciate that each of the ends of each of the skirts includes an individual surface preferably positioned adjacent reflector 32. Thus, during assembly, reflector 32 is preferably positioned against surfaces 37 and 39 and fixed in the desired position. Any suitable means for mounting reflector 32 against the skirts may be used, for example, an adhesive, welding, fasteners or by placing a plug between reflector 32 and the inner peripheral wall of casing 34 such that reflector 32 is held against the locating surfaces. In an embodiment utilizing a flat reflector, skirts 41 and 43 are preferably formed such that locating surfaces 37 and 39 are substantially in a common plane, whereas in a curved reflector design locating surfaces 37 and 39 may be non-coplanar so accommodate the curve of the reflector.

Figure 5:
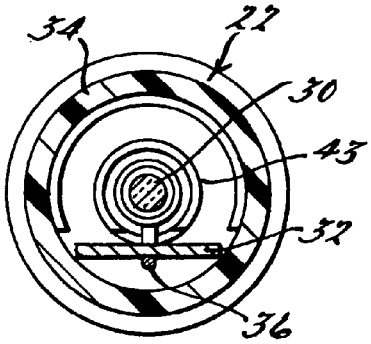
FIG. 5 is a partially sectioned view taken along line 5—5 of FIG. 2.

In either a flat mirror or curved mirror design, it is preferred to position locating surfaces 37 and 39 such that reflector 32 and bulb 30 are at the preferred orientation, i.e. separated by a distance that maximizes the amount of light reflected by reflector 32 (in the case of the preferred parabolic reflector, the focal point thereof). Alternative embodiments are contemplated wherein the distance between reflector 32 and bulb 30 is varied, or where the curvature of reflector 32 is modified, to create different lighting characteristics. Thus, the present invention further provides a method of assembling an illumination device, including the steps of positioning a lighting element 30 in an outer casing 34, positioning an end cap 40 in the casing 34, and positioning a reflector 32 in the casing at a preselected distance from the lighting element 30, wherein the preselected distance is defined by at least one locating surface 37, 39 on the end cap 40. FIG. 5 illustrates a partially sectioned view taken along line 5—5 of FIG. 2.

Figure 6:
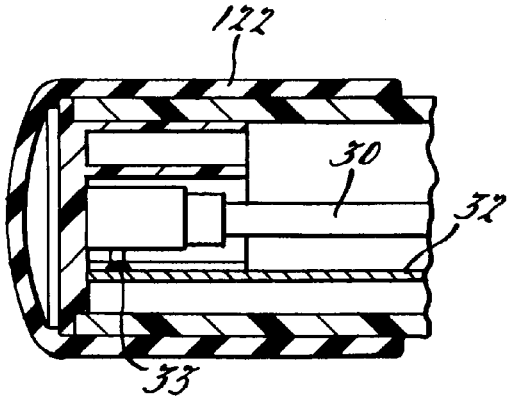
FIG. 6 is a partially sectioned view of a part of an illumination device according to the present invention.

FIG. 6 illustrates a partially sectioned view similar to FIG. 2, wherein an electrical connection 33 is formed between bulb 30 and reflector 32, for example, by soldering the electrical connector at the end of the bulb directly to reflector 32. Because reflector 32 is preferably formed from a conductive metal, or coated with an electrically conductive material, the reflector itself can serve as the electrical return line, dispensing with the need for line 36 shown in FIG. 2.

Figure 3:
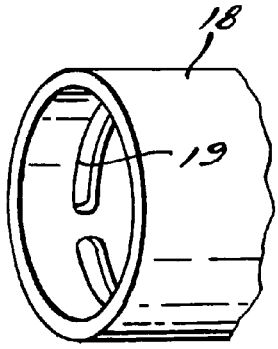
FIG. 3 is a perspective view of a fitting for an illumination device according to the present invention.
Figure 7:
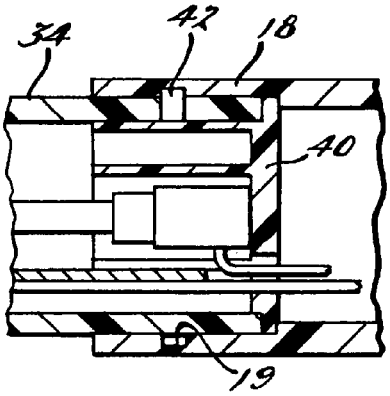
FIG. 7 is a partially sectioned view taken along line 7—7 of FIG. 1.

Turning now to FIGS. 3 and 7, there are shown respectively a perspective view of fitting 18 and a sectioned view taken along line 7—7 of FIG. 1*a*. Fitting 18 is preferably substantially cylindrical, and includes a partially circular groove 19 formed around an inner peripheral wall thereof. A protrusion, for example a rivet 42 is preferably fixed to an end cap 40, similar to the end cap described with respect to FIGS. 2, 4 and 5. In a preferred embodiment, protrusion 42 extends into groove 19, and allows the end cap (and the associated unit 14) to be rotated relative to fitting 18, the protrusion 42 traversing the length of groove 19 between opposite ends thereof. It should be noted that any typed of protrusion known may also be used in the present invention. Because groove 19 is preferably only partially circular, relative rotation is limited to less than 360°. Consequently, the electrical connections between bulb 30 and electrical housing 16 do not become overly twisted, but the light itself can be adjusted to varying angles. Thus, when apparatus 10 is positioned, for example, in a kitchen cabinet or under some other surface, the light can be adjusted to illuminate different areas. Protrusion 42 may extend from end cap 40 through casing 34, or it may be attached only to casing 34. Alternatively, casing 34 need not extend all the way along end cap 40 to the point at which protrusion 42 is attached and extends there from. It is also contemplated to have a groove 19 for casing 34 with a protrusion extending from fitting 18.

Figure 8:
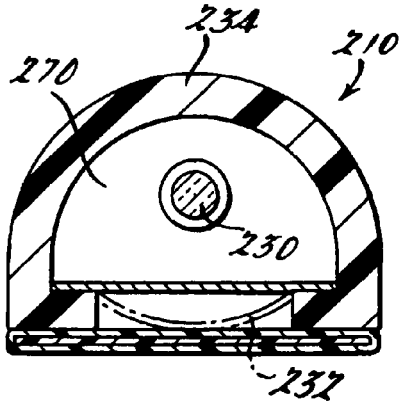
FIG. 8 is an end view of an illumination device according to the present invention.
Figure 10A:
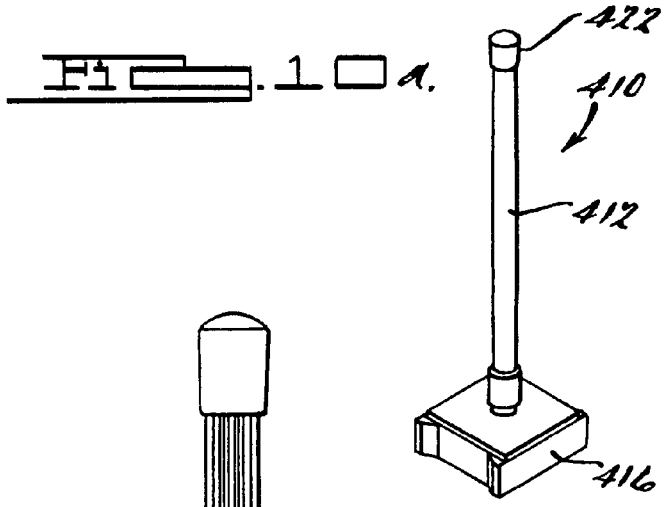
FIGS. 10*a*–10*d* illustrate various perspective views of an illumination device according to the present invention.
Figure 10B:
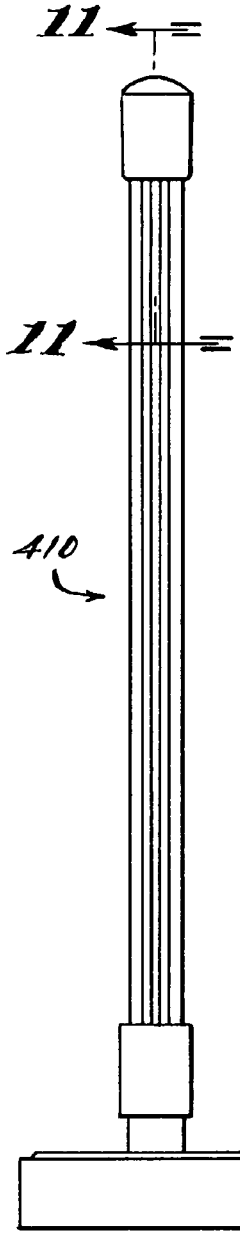
Figure 10C:
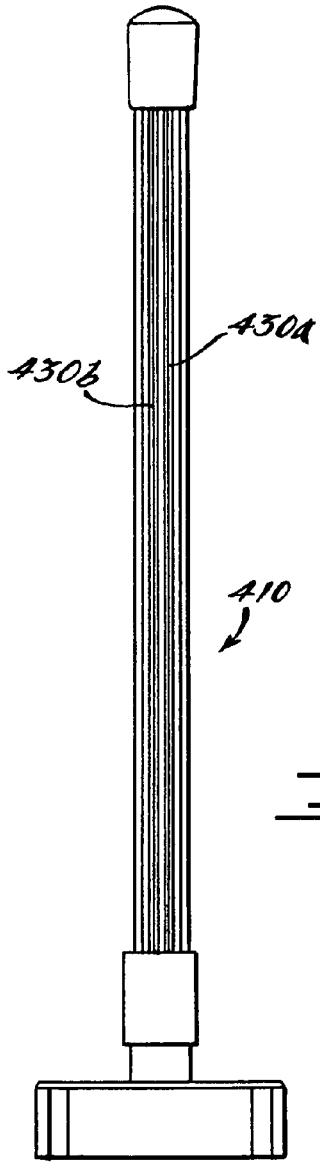
Figure 10D:
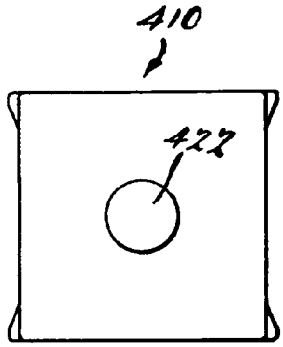
Figure 12:
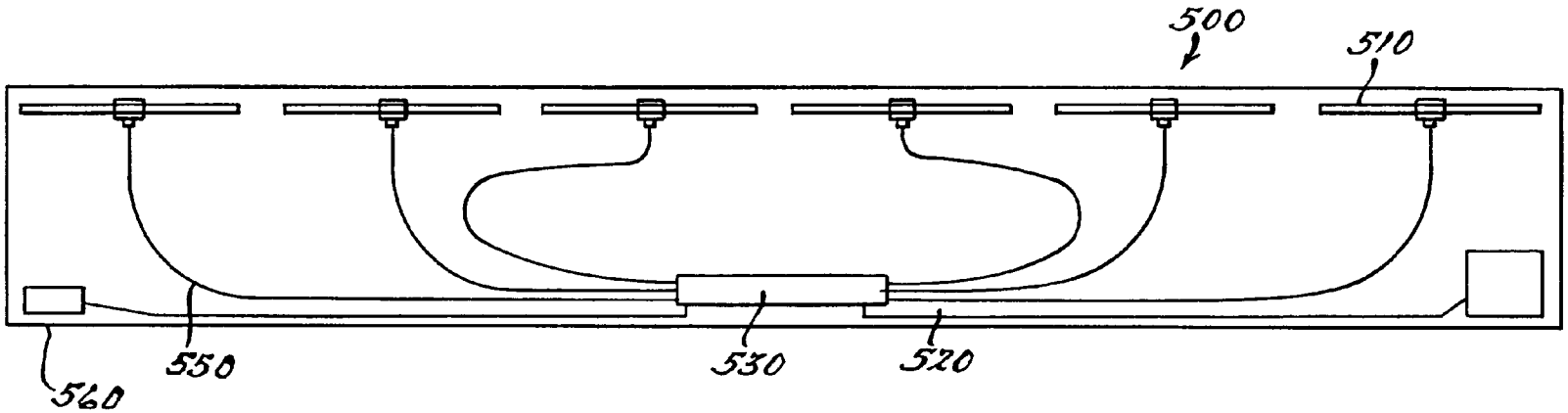

Turning now to FIG. 8, there is shown an alternative design for an illumination device 210 wherein a casing 234 is provided that is substantially half round, however, any other shape may also be used such as, but not limited to, half elliptical, half oval, half rectangle, half triangle, etc. The FIG. 8 embodiment is similar to the foregoing embodiments, however, it differs primarily in the shape of casing 234, which allows the illumination device 210 to have as low a profile as possible. Device 210 further includes a reflector 32, preferably parabolic in cross section, a bulb 230.

Device 210 preferably further includes an interior space 270, preferably air filled and extending a length of bulb 230 between the same and casing 234. It should be noted that any known gas, liquid or vapor may also fill interior space 270. Space 270 is an air-filled space surrounding bulb 230 and, accordingly, provides an insulative surrounding for bulb 230. During cold start conditions, the air in space 230 is believed to assist in starting bulb 230, both by attenuating temperature changes due to ambient conditions, and by insulating bulb 230 once starting of the bulb is attempted. It should be appreciated that all of the embodiments described herein preferably include an air-filled space similar to device 210, and its description should be understood to refer similarly thereto except as otherwise indicated.

Figure 9:
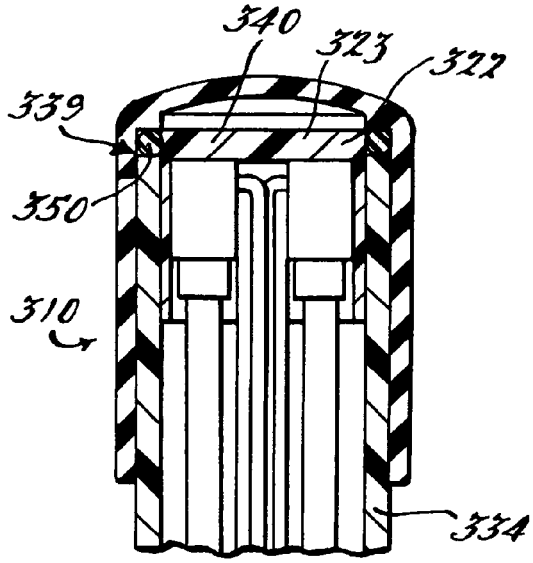
FIG. 9 is a partially sectioned view of a part of an illumination device according to the present invention.

Turning now to FIG. 9, there is shown an alternative embodiment of the present invention. An illumination device 310 is provided, having an outer casing 334, preferably a cylindrical, extruded tube, an end cap 340, and an outer covering 322. An O-ring 350 is preferably provided and forms a four point seal at the end of illumination device 310. End cap 340, which may be an end cap similar to end caps 40 described above, is preferably placed into an end of casing 334 to a depth such that a portion of end cap 340 extends from the end of casing 334. O-ring 350 is then preferably positioned over the portion of end cap 340 that extends from casing 334, and placed adjacent an end 339 of casing 334. End covering 322 is subsequently positioned over the end of end cap 340 and casing 334 to a point at which an internal wall 323 of end covering 322 bears against O-ring 350. End covering 322 is then pushed to the desired point, degree of tightness, forming a four point seal at approximately four equidistant radial positions relative to a cross section of O-ring 350.

FIGS. 10*a–d* illustrate yet another embodiment of the present invention. An illumination device 410 is provided that includes an electrical housing or base 416 and an illumination unit 412 that extends approximately from a center of base 416 at an orientation orthogonal to a top surface thereof. In a preferred embodiment, a push button switch (not shown) is positioned on base 416 and allows unit 412 to be illuminated as desired. An end covering 422 is preferably positioned over an end of unit 412. Device 410 is preferably formed having a plurality of bulbs 430*a* and 430*b*, for example two.

Figure 11:
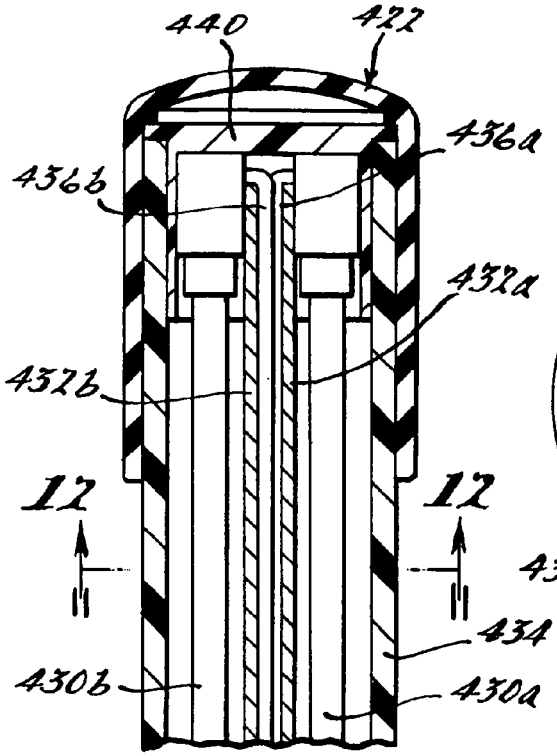
FIG. 11 is a partially sectioned view taken along line 11—11 of FIG. 10*b;*
Figure 12:
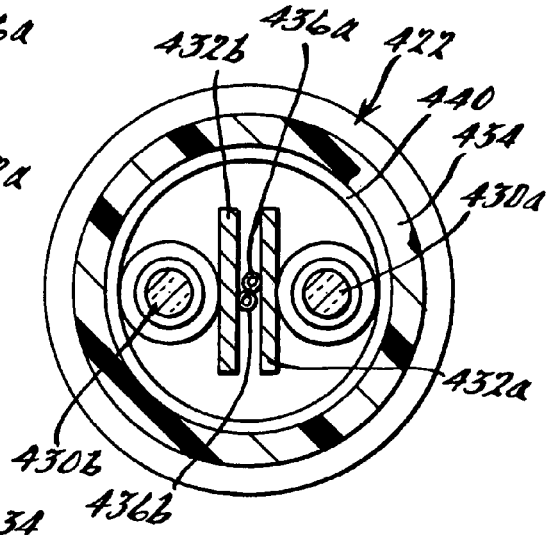
FIG. 12 is a partially sectioned view taken along line 12—12 of FIG. 11.

Referring also to FIGS. 11 and 12, there are shown cross sectional views of device 410. FIG. 11 is a cross section taken along line 11—11 of FIG. 10*b*, whereas FIG. 12 is a cross section taken along line 12—12 of FIG. 11. In a preferred embodiment, bulbs 430*a* and 430*b* are positioned within an outer casing 434, an end cap 440 is positioned within casing 434 and a set of reflectors 432*a* and 432*b* are positioned between bulbs 430*a* and 430*b*. Electrical return lines 436*a* and 436*b* are "sandwiched" between reflectors 432*a* and 432*b*. Reflectors 432*a* and 432*b* are shown as flat reflectors, however, curved reflectors such as parabolic reflectors are preferably used.

Turning to FIG. 13, there is shown a lighting system 500 having a plurality of lighting units 510, for example T-shaped units similar to those of FIGS. 1*a–e*. System 500 further preferably includes a primary power supply 520, an inverter 530 and primary/secondary power supply, a plurality of high voltage connectors 550 and a remote on/off switch or intensity control switch 560. System 500 is applicable to any environment where it is desirable to have a plurality of units operable from a single control. One suitable application might be, for example, in multiple displays cases, each having a separate light, but it being desirable to control all of the lights from a single switch or dimmer.

Still further embodiments are contemplated (not shown) wherein the lighting/illumination devices described herein are incorporated into portable units. The relatively low power consumption for a given light output makes such devices particularly well suited to outdoor or rural environments, or where power is unreliable or at a premium. Moreover, the four-point sealing design, which can be incorporated into any of the embodiments described herein, can provide water-resistant or waterproof illumination devices for use in environments where splashing or immersion is a threat.

The present description is for illustrative purposes only and should not be construed to narrow the scope of the present invention in any way. Thus, those skilled in the art will appreciate that various modifications might be made to the presently disclosed embodiments without departing from the spirit and scope of the present invention. Other aspects, features and advantages will be apparent upon an examination of the attached drawings and appended claims.

The invention claimed is:

1. A fluorescent illumination device comprising:

an elongate bulb;

an outer casing substantially coextensive with said bulb, said casing at least partially surrounding the bulb and defining an interior space;

an end cap positioned at an end of said outer casing, said end cap including a skirt extending radially about an end of said bulb;

said end cap having at least one locating surface defined by said skirt, said skirt including coaxial first and second partially cylindrical skirts, wherein each of said skirts includes opposite ends separated by gaps, each of said ends having locating surfaces thereon lying substantially in common planes;

a reflector extending longitudinally in said interior space, said reflector having an end portion against said locating surface and thereby maintained at a preselected distance from said bulb.

2. The device of claim 1 comprising two locating surfaces.

3. The device of claim 2 wherein said skirt comprises a partially cylindrical thin wall with opposite ends separated by a gap, said locating surfaces on said opposite ends.

4. The device of claim 1 comprising a substantially half cylindrical casing.

5. A fluorescent illumination device comprising:

an elongate bulb;

an outer casing substantially coextensive with said bulb, said casing at least partially surrounding the bulb and defining an interior space;

an end cap positioned at an end of said outer casing, said end cap including a skirt extending radially about an end of said bulb;

said end cap having at least one locating surface defined by said skirt;

a reflector extending longitudinally in said interior space, said reflector having an end portion against said locating surface and thereby maintained at a preselected distance from said bulb, said reflector is an electrical return in an electrical circuit for powering said bulb.

6. A fluorescent light apparatus comprising:

a translucent or transparent elongate cylindrical casing defining an interior space;

an elongate bulb extending in said interior space;

an end cap positioned at an end of said casing;

a protrusion connected to and extending outwardly from said casing proximate an end thereof;

a mounting member positioned at the end of said casing and having a substantially cylindrical inner wall positioned about said casing;

a partially circular groove formed in and extending about said inner wall, said groove having first and second ends;

said protrusion is movably positioned in said groove;

said protrusion is movable between said first and second ends of said groove, relative rotation between said casing and said mounting member being less than 360°.

7. An illumination apparatus comprising:

a substantially cylindrical hollow casing having a wall thickness;

an elongate bulb extending in said casing;

an end cap positioned in said casing and including a portion extending from an end thereof;

a flexible O-ring positioned about the portion of said end cap that extends from said casing, said O-ring having a thickness greater than said wall thickness;

an inner diameter of said O-ring forms a first seal with said end cap, said O-ring forming a second seal with an end of said casing at approximately 90° from said first seal relative to a cross section of said O-ring;

a cover positioned over an end of said casing, an inner wall of said cover forming a third seal with said O-ring substantially opposite said first seal, and an end wall of said cover forming a fourth seal with said O-ring substantially opposite said second seal.

8. A fluorescent light comprising:

a base having a top surface;

an elongate, substantially cylindrical casing mounted to said base and extending orthogonal to said top surface;

first and second elongate bulbs extending in said casing;

first and second reflectors positioned between said first and second bulbs; and first and second electrical lines positioned at or near a centerpoint of said casing and between said first and second reflectors, said lines electrically connected with said first and second bulbs, respectively.

9. A fluorescent light apparatus comprising:

a base;

a T-shaped mounting member extending from said base;

a first and a second casing extending from opposite sides of said T-shaped mounting member;

a first bulb and a second bulb extending in said first and second casings, respectively;

wherein each of said first and said second casing is rotatable with respect to said T-shaped mounting member, adjusting an orientation of first and second reflectors relative to said base, each of said first and second casings is rotatable less than 360° relative to said mounting member.

10. The apparatus of claim 9 wherein said T-shaped mounting member comprises:

a first sleeve positioned about an end of said first casing;

a second sleeve positioned about an end of said second casing;

each of said sleeves having a groove extending about an inner periphery thereof;

wherein a protrusion extends from each of said first and said second casings extends into the respective grooves, an engagement of each protrusion therein limiting rotation of the respective casing to less than 360°.

11. A plurality of apparatuses according to claim 10 and connected serially or in parallel within an electrical circuit.

* * * * *

UNITED STATES PATENT AND TRADEMARK OFFICE

CERTIFICATE OF CORRECTION

PATENT NO. : 7,245,069 B2
APPLICATION NO. : 10/913830
DATED : July 17, 2007
INVENTOR(S) : Frederick William Elvin It is certified that error appears in the above-identified patent and that said Letters Patent is hereby corrected as shown below:

Col. 4, Line 45 - Please replace " typed " with --type, -- after "It should be noted that any".

Signed and Sealed this

Fourth Day of September, 2007

JON W. DUDAS
*Director of the United States Patent and Trademark Office*